US006585610B2

(12) United States Patent
Sompolinsky

(10) Patent No.: US 6,585,610 B2
(45) Date of Patent: Jul. 1, 2003

(54) PORTABLE STOOPBALL PLAYING DEVICE

(76) Inventor: Mark Sompolinsky, 1126 E. 29th St., Brooklyn, NY (US) 11210

( * ) Notice: Subject to any disclaimer, the term of this patent is extended or adjusted under 35 U.S.C. 154(b) by 0 days.

(21) Appl. No.: 09/902,291

(22) Filed: Jul. 10, 2001

(65) Prior Publication Data

US 2003/0013561 A1 Jan. 16, 2003

(51) Int. Cl.[7] ..... A63B 69/00; A63B 63/00; F41J 3/00; F41J 1/00

(52) U.S. Cl. ..... 473/435; 473/431; 273/348; 273/396

(58) Field of Search ..... 473/421, 415, 473/422, 197, 434, 435, 454–456, 446, 449, 423, 476, 494, FOR 116; 273/348, 396, 382, 407, 410, 395, DIG. 31

(56) References Cited

U.S. PATENT DOCUMENTS

| | | | | | |
|---|---|---|---|---|---|
| 999,940 | A | * | 8/1911 | Wood | 473/512 |
| 1,983,044 | A | * | 12/1934 | Maynard | 273/DIG. 31 |
| 2,104,375 | A | * | 1/1938 | Perry | D25/123 |
| 2,812,946 | A | * | 11/1957 | Hughes | 473/465 |
| 3,564,790 | A | * | 2/1971 | Rehfeld | 108/92 |
| 3,876,070 | A | * | 4/1975 | Nagy | 273/348 |
| 4,026,551 | A | * | 5/1977 | Larson | 473/454 |
| 4,421,318 | A | * | 12/1983 | Sverdlik et al. | 473/476 |
| 5,407,210 | A | * | 4/1995 | Canning | 273/348 |
| 5,531,449 | A | * | 7/1996 | Denton | 273/348 |
| 5,833,234 | A | * | 11/1998 | Vavala et al. | 273/400 |
| 5,967,519 | A | * | 10/1999 | Cumberland et al. | 273/396 |
| 6,328,665 | B1 | * | 12/2001 | Gormley | 473/417 |

* cited by examiner

*Primary Examiner*—Paul T. Sewell
*Assistant Examiner*—Mitra Aryanpour
(74) *Attorney, Agent, or Firm*—Gibbons, Del Deo, Dolan, Griffinger & Vecchione

(57) ABSTRACT

A portable stoopball playing device comprising a playing panel and a support panel connected to said playing panel. The playing panel and the support panel are moveable relative to each other between at least one open deployed position and a closed storage position. The playing panel includes a plurality of sheer surfaces and protrusions on its playing surface, which allow for random and unpredictable rebounding of a ball thrown at the playing panel. The playing panel further includes a vertical curvature and a horizontal curvature, which may be convex, thereby increasing the rebounding angle of the thrown ball, thereby increasing the number of players able to participate in a single game. The horizontal curvature alternatively may be concave, thereby permitting the player to control and direct the rebounding angle of the thrown ball. The playing panel also includes a weighting channel which may be filled with a ballast substance. A portable stoopball playing device wherein the support panel is replaced by a triangular brace attached to each lateral edge of the playing panel. The triangular braces may be hollow, in which case they may be filled with a ballast substance. A portable stoopball device wherein the support panel is replaced by folding support legs attached to the rear of the playing panel near the lateral edges thereof.

26 Claims, 6 Drawing Sheets

PORTABLE STOOPBALL PLAYING DEVICE

CROSS-REFERENCE TO RELATED PATENT APPLICATIONS

None.

STATEMENT REGARDING FEDERALLY SPONSORED RESEARCH OR DEVELOPMENT

Not Applicable.

BACKGROUND OF THE INVENTION

1. Field of the Invention

The present invention relates to a device for playing a rebound ball game, and more specifically, to a portable device for playing stoopball.

2. Discussion of the Related Art

In the past, children living in the cities of the Northeastern United States were quite familiar with the popular pastime of stoopball, a game which mimics baseball, in which a ball is thrown at the steps of a brownstone house thereby causing it to rebound. As with most outdoor sporting activities, one of the advantages of stoopball was that it allowed children to play outdoors while at the same time occupying their time and preventing them from getting into the colloquial trouble. Unfortunately, the modern city has all but eliminated this pastime. The combination of traffic, insurance, health restrictions, crime and intolerance of children has left kids with no playing field and little recourse.

It would be beneficial, then, to resuscitate this pastime. One way of doing this is by transferring the stoopball playing field from the unsafe streets to the local parks, or even to the backyard of an individual. To do so, however, requires a portable stoopball device which can replace the brownstone steps.

Additionally, while portable stoopball playing devices are known in the art, those devices are generally simple rebound devices. None of the prior devices includes elements that allow for random or unpredictable rebounding of the thrown ball, or the inclusion of multiple players in a single game. Further, none of the prior devices includes elements that allow for the player to control and direct the rebounding angle of the thrown ball.

What is needed is a cost-effective portable stoopball playing device that can mimic the rebounding characteristics of the brownstone steps, and allows the user to place the striking surface in whatever location the user desires. What also is needed is a portable stoopball playing device which allows for unpredictable rebounding of the thrown ball. What is also needed is a portable stoopball playing device that allows for the inclusion of multiple players in a single game. What also is needed is a portable stoopball playing device that allows a player to control and direct the rebounding angle of the thrown ball.

Accordingly, the present invention provides a cost-effective portable stoopball playing device that mimics the rebounding characteristics of the brownstone steps, and further allows the user to place the striking surface in any location the user desires. The present invention also includes elements that allow for unpredictable rebounding of the thrown ball. The present invention also includes elements that allow for the inclusion of multiple players in a single game. The present invention also includes elements that allow the player to control and direct the rebounding angle of the thrown ball.

BRIEF SUMMARY OF THE INVENTION

The present invention is a portable stoopball playing device.

In a preferred embodiment, the stoopball playing device is comprised of a rectangular playing panel and a support panel, each having an inner surface and an outer surface and circumscribed by a top edge, two lateral edges, and a bottom edge. The playing panel has a vertical curvature and a horizontal curvature, which may be either concave or convex, as well as a hollow weight channel extending the width of the bottom (surface) edge. The outer (playing) surface of the playing panel has sheer face segments, and one or more protrusions. The support panel and playing panel are hingeably attached to each other at the top edges thereof and are moveable between at least one open deployed position and a closed storage position. The support panel also has both a vertical curvature and a horizontal curvature, the horizontal curvature of the support panel being complimentary to that of the playing panel, such that when the playing panel and support panel are in the closed storage position, the inner surface of the playing panel is flush with the inner surface of the support panel. A person can throw a ball against the surface of the playing panel and rebound the ball at different angles and speeds depending on how the ball is thrown.

In another embodiment, the portable stoopball playing device is comprised of a rectangular playing panel as described above and a lateral triangular brace support structure. The lateral triangular brace support structure is comprised of two triangular face braces each having a slot into which the playing panel is inserted; two support channels; and a receiving station. The triangular brace structure also includes a spreader bar running parallel to the playing panel and coupleable to each of the triangular face braces at the receiving stations. As above, a person can throw a ball against the playing panel and rebound the ball at different angles and speeds depending on how the ball is thrown.

In still another embodiment, the support panel described above is replaced by a plurality of folding support legs hingeably attached to the inner surface of the rectangular playing panel, and movable about the hinged attachment between an open deployed position and a closed flush position. Each folding support leg comprises an angled vertical support member hingeably attached to the rear surface at a point near the top edge of the playing panel, and a horizontal brace member hingeably attached at a point near the bottom surface edge of the playing panel, the angled vertical support member being attached to the horizontal brace member to form the folding support leg. The playing panel remains as described above. As above, a person can throw a ball against the playing panel and rebound the ball at different angles and speeds depending on how the ball is thrown.

DETAILED DESCRIPTION OF THE INVENTION

Figure 1:
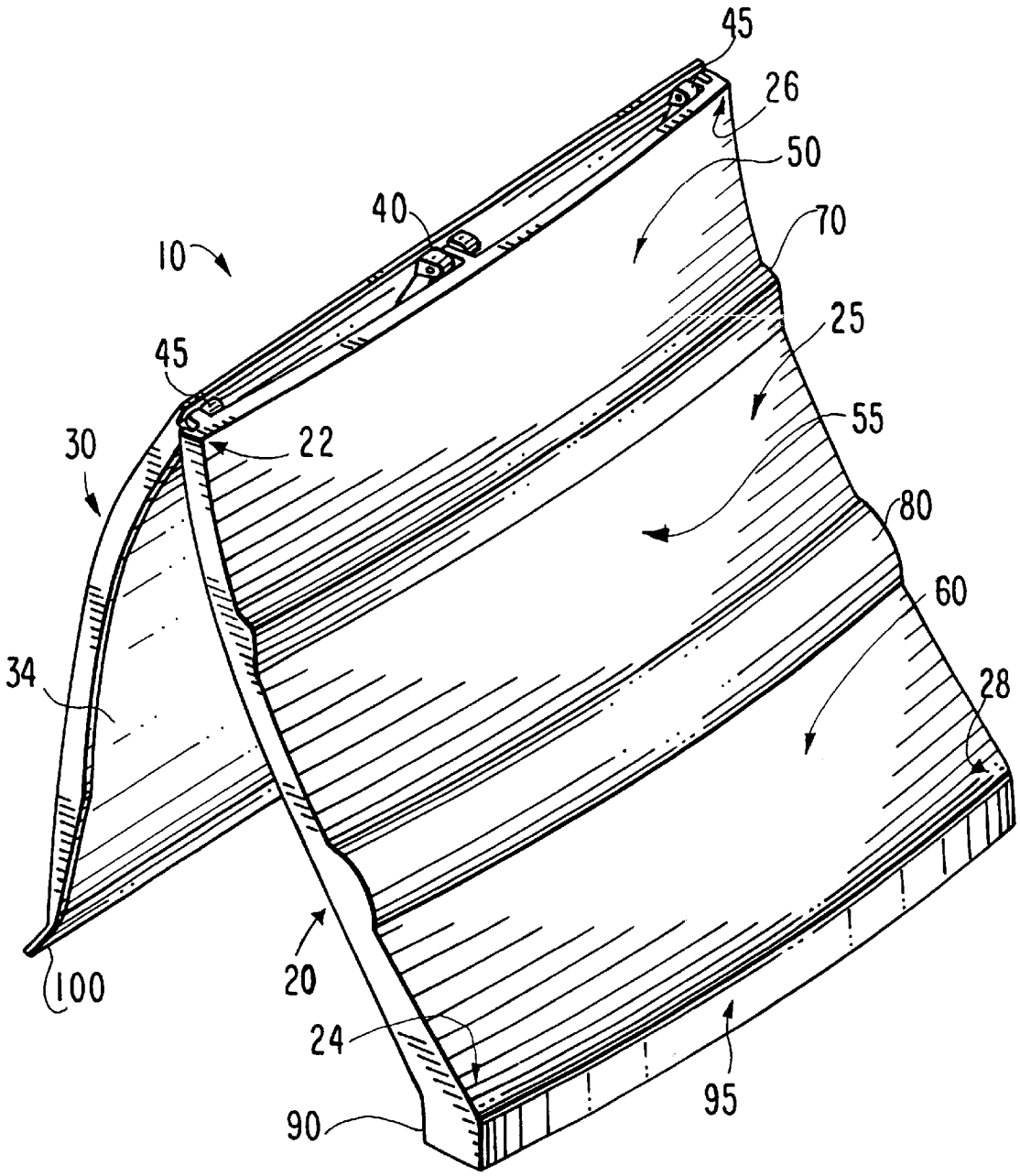
FIG. 1 is a perspective view of one embodiment of the portable stoopball playing device of the present invention, showing the playing panel and the support panel hingeably attached, the one to the other.

Turning to FIG. 1, the stoopball playing device 10 of the present invention comprises a playing panel 20 and a support panel 30. Playing panel 20 and support panel 30 preferably are constructed from plastic, though they may be constructed from other lightweight materials such as wood or aluminum. Playing panel 20 includes a generally rectangular outer playing surface 25, against which a ball may be thrown, a generally rectangular inner surface 27, a surface edge 90 on which the playing panel rests when the playing device 10 is deployed, a top edge which is the edge of playing panel 20 opposite the surface edge 90, and two parallel lateral edges. Support panel 30 includes a generally rectangular outer surface 32 and a generally rectangular inner surface 34, a bottom edge on which the support panel is propped when the playing device 10 is deployed, a top edge, which is the edge of support panel 30 opposite the bottom edge, and two parallel side edges. The bottom edge of support panel 30 may also include one or more ground spikes (not shown), which are hingeably attached to the bottom edge of support panel 30. When the playing device is deployed on a lawn or other permeable surface, the ground spikes may be inserted into the surface, thereby increasing the overall stability of the playing device.

The two panels 20, 30 may be connected to each other by a group of hinges 40, 45 collectively termed a hinge assembly. As illustrated, the hinge assembly may consist of center hinge 40 located in the center of the top edge of each panel, as well as side hinges 45 located on the top edge of each panel, on either side of the center hinge 40, and spaced equidistant therefrom. So attached, the playing panel 20 and support panel 20 are moveable between one or more open, or deployed positions, wherein playing panel 20 is separated from support panel 30 a distance sufficient to allow the surface edge 90 of the playing panel 20 and the bottom edge of the support panel 30 to rest flush against the surface on which the device 10 is placed and the device is sufficiently stable for use, and a closed position, wherein the inner surface 27 of the playing panel 20 is flush with the inner surface 34 of the support panel 30. The open, or deployed positions are such that the vertical rebounding angle of the thrown ball may be increased or decreased, depending upon the desires of the player.

Figure 2:
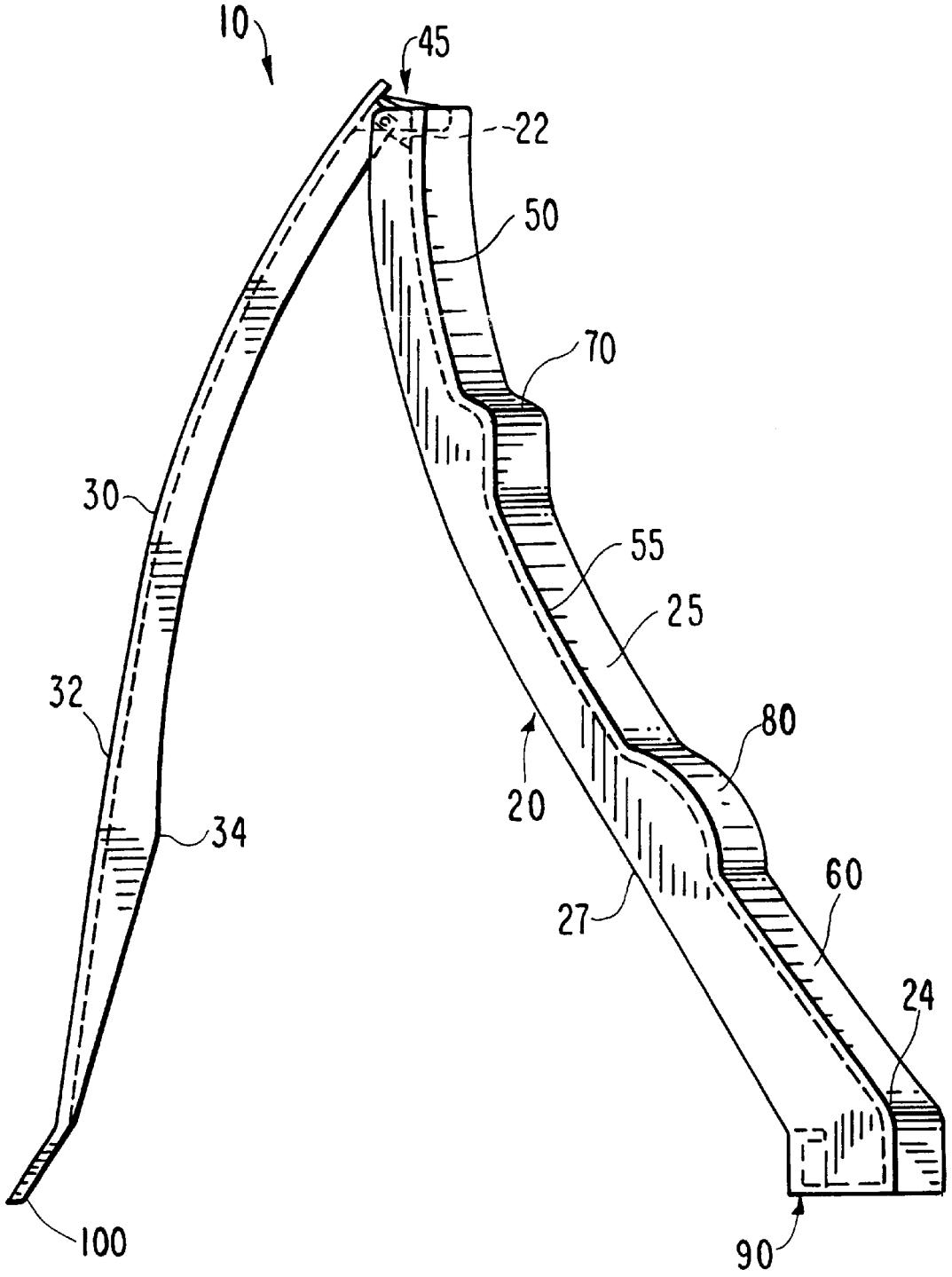
FIG. 2 is a side view of the embodiment of FIG. 1.

As illustrated in FIG. 1, the playing panel 20 may exhibit a dual curvature. The vertical curvature of the playing panel 20 may occur between the top of the panel, represented by points 22 and 26 and the bottom of the panel, represented by points 24 and 28. FIG. 2, which shows a side view of the playing device 10, best illustrates the vertical curvature of playing panel 20. As can be seen in FIGS. 1 and 2, the supporting panel 30 may exhibit a corresponding vertical curvature complimentary to that of the playing panel 20, so that when the two panels are folded inwards, the inner surface 34 of support panel 30 and inner surface 27 of playing panel 20 are flush against each other.

Figure 2A:
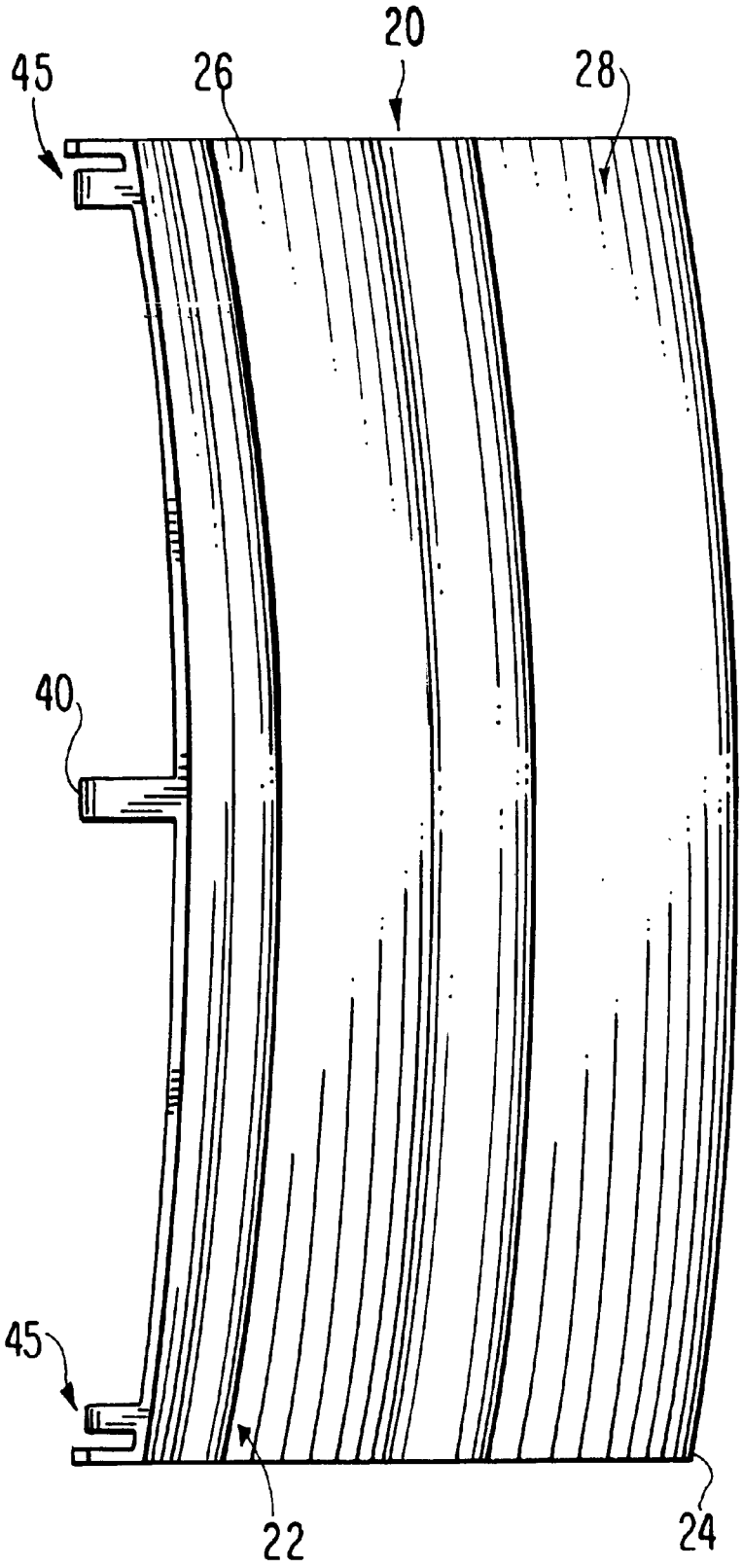
FIG. 2A is a top perspective view of the outer playing surface of a playing panel of the portable stoopball playing device of the present invention, showing the playing panel having a convex horizontal curvature.

Playing panel 20 may also exhibit a horizontal curvature. As illustrated in FIG. 2A, the horizontal curvature of the playing panel 20 may be slightly convex, so that the points 22 and 26 and the points 24 and 28 curve outwards from each other, respectively. Alternatively, the horizontal curvature may be slightly concave, in which instance (not shown) points 22 and 26 and points 24 and 28 curve inward towards each other, respectively. Again, the supporting panel 30 may exhibit corresponding horizontal curvature complimentary to that of the playing panel 20, so that when the two panels are folded inwards, the respective inner surfaces 27, 34 of the panels 20 and 30 sit flush against each other.

The benefit of a convex horizontal curvature for the playing panel 20 is as follows: When a ball is thrown at a flat surface, such as a step, the number of players able to participate in the game is usually limited to two, a pitcher and a catcher. As a result, a single game of stoopball effectively precludes group playing. By contrast, when a ball is thrown at a convex (outward) curved surface, the ball can bounce back across a significantly wider angle, permitting for multiple players, in addition to the pitcher. Because of the convex horizontal curvature of the playing panel 20, the rebound of a thrown ball can be directed at a wider ranger range of catchers, thus increasing the number of players able to participate in a single game.

The benefit of a concave horizontal curvature for the playing panel 20 is as follows: When a ball is thrown against a flat surface, such as a step, the rebounding angle of the thrown ball cannot be controlled to any great degree by the player. By contrast, when a ball is thrown at a concave (inward) curved surface, the rebounding angle of the thrown ball can be controlled by the player. For example, if the player wishes the thrown ball to rebound to his right, he will throw the ball at the left side of the concave (inward) curved surface. The concave (inward) curves surface thus allows a player to control and direct the rebounding angle of the thrown ball, thereby significantly increasing the potential enjoyment afforded by the game.

The outer playing surface 25 of playing panel 20 may also have protrusions 70, 80. In a preferred embodiment, protrusion 70 is a sharp, horizontal protruding edge, which is representative of the 90-degree edge found in the typical staircase design. Also in a preferred embodiment, protrusion 80 is a convexly curved edge, representative of a rounded edge found in other staircase designs. Of course, the playing panel 20 may have neither of the protrusions 70, 80, or one type but not the other, or both types, or even more than two types. A ball which is incident upon one of these protrusions 70, 80 will have a vastly different angle of reflection than a ball that is incident upon the sheer segments of the playing panel walls 50, 55, 60 thereby providing variety and excitement to the stoopball game.

The inner surface 27 of playing panel 20 may also be covered with an insulating material to dampen the sound of the ball or other object striking the outer playing surface 25. The insulating material may consist of rigid foam or other suitable material covering the inner surface 27 wherever it is recessed (i.e., in complement to protrusions 70, 80), and may subsequently be covered entirely with a layer of resilient material providing a smooth protective covering that is impervious to moisture and ultraviolet radiation, and which also resists impact damage.

Alternatively, the sound of the ball or other object striking outer playing surface 25 may be dampened by the addition of one or more rigid thin ribs (not shown) to inner surface 27 of playing panel 20 at a point between the portions of inner panel 27 corresponding to the nodal point(s) where the vibration caused by the ball or other object striking outer playing surface 25 is at maximum amplitude. Nodal areas will be identified during manufacture through the use of accelerometers and computer simulations, which will create a "map" of the nodal areas of the outer playing surface 25. Rigid thin ribs will be added to identified nodal areas of inner surface 27 in the following portions of said inner surface 27: between the top edge and the portion of inner surface 27 corresponding to protrusion 70; between the portion of inner surface 27 corresponding to protrusion 70 and the portion of inner surface 27 corresponding to protrusion 80; and between the portion of inner surface 27 corresponding to protrusion 80 and surface edge 90. Where only a single protrusion 70 or 80 is included, the rigid ribs will be added to the identified nodal areas of inner surface 27 as follows: between the top edge and the portion of inner surface 27 corresponding to the protrusion 70 or 80; and between the portion of inner surface 27 corresponding to the protrusion 70 or 80 and surface edge 90. Where no protrusions are included in playing surface 25, the rigid thin ribs will be added to the identified nodal areas of inner surface 27 between the top edge and the surface edge 90.

Addition of the thin ribs to inner surface 27 at the identified nodal areas will stiffen those nodal areas and acoustically couple each such area to its neighbor. As a result, a single frequency will result that is of a lower order than the original frequency.

The rigid thin ribs will be arranged so as to be perpendicular to surface edge 90. Further, the rigid thin ribs will not be discrete components of inner surface 27, but will be formed during manufacture of the stoopball playing device. The thickness and dimensions of the ribs will be such that the frequency of playing panel 20 will be lowered into the sub-sonic region where it is not detectable by the human ear. The length of the rigid thin ribs will be determined during the process of identifying the nodal areas. Where necessary, the rigid thin ribs may be of a length such that the ribs extend the full length of the portion of inner surface 27 between top edge and protrusion 70, protrusion 70 and protrusion 80, and/or protrusion 80 and surface edge 90. In such case, the rigid thin ribs will intersect the stiffest section of top edge/protrusion(s) 70, 80/surface edge 90, thereby anchoring the rigid thin rib to its stiffer neighboring structures and furthering the dampening effect of the ribs.

The playing panel 20 includes a surface edge 90 which is flush with the surface upon which the deployed device 10 sits. In a preferred embodiment, a hollow weight channel 95 extends along the width of the playing panel 20, from point 24 to point 28. Removable weight containers (not shown) may fit into the hollow weight channel 95. Each container may have an approximate capacity of 1 gallon and may be filled with a ballast substance such as water or sand. After the containers have been filled, they may be inserted into the weight channel 95. As a result, the stoopball playing device 10 is weighted down and movement of the device upon ball impact is restricted. The supporting panel 30 may end in a bent panel 100 which forms an acute angle with the surface upon which it sits.

Figure 3:
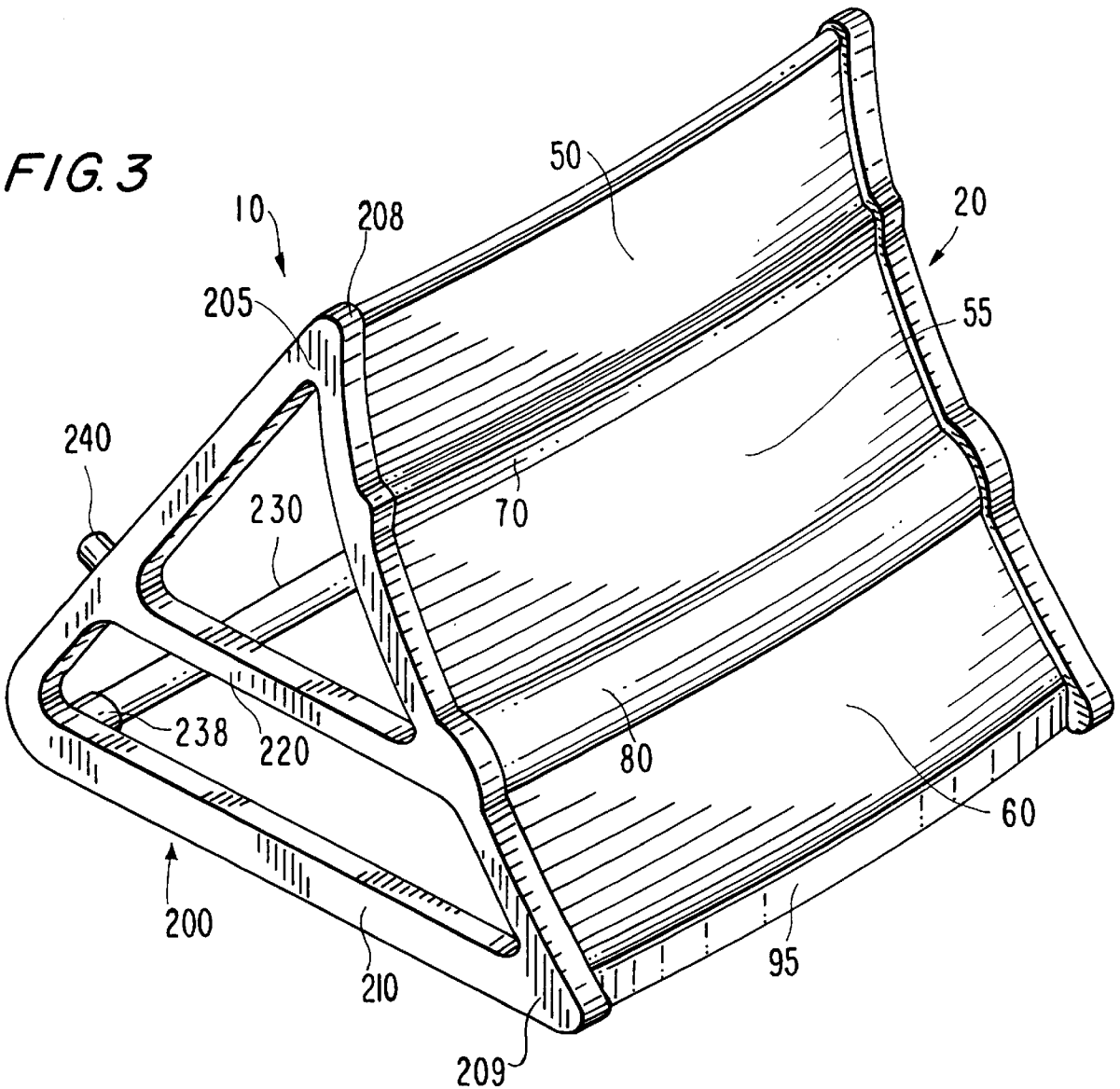
FIG. 3 is a perspective view of another embodiment of the portable stoopball playing device of the present invention, showing the playing panel attached to one of the triangular face braces.
Figure 4:
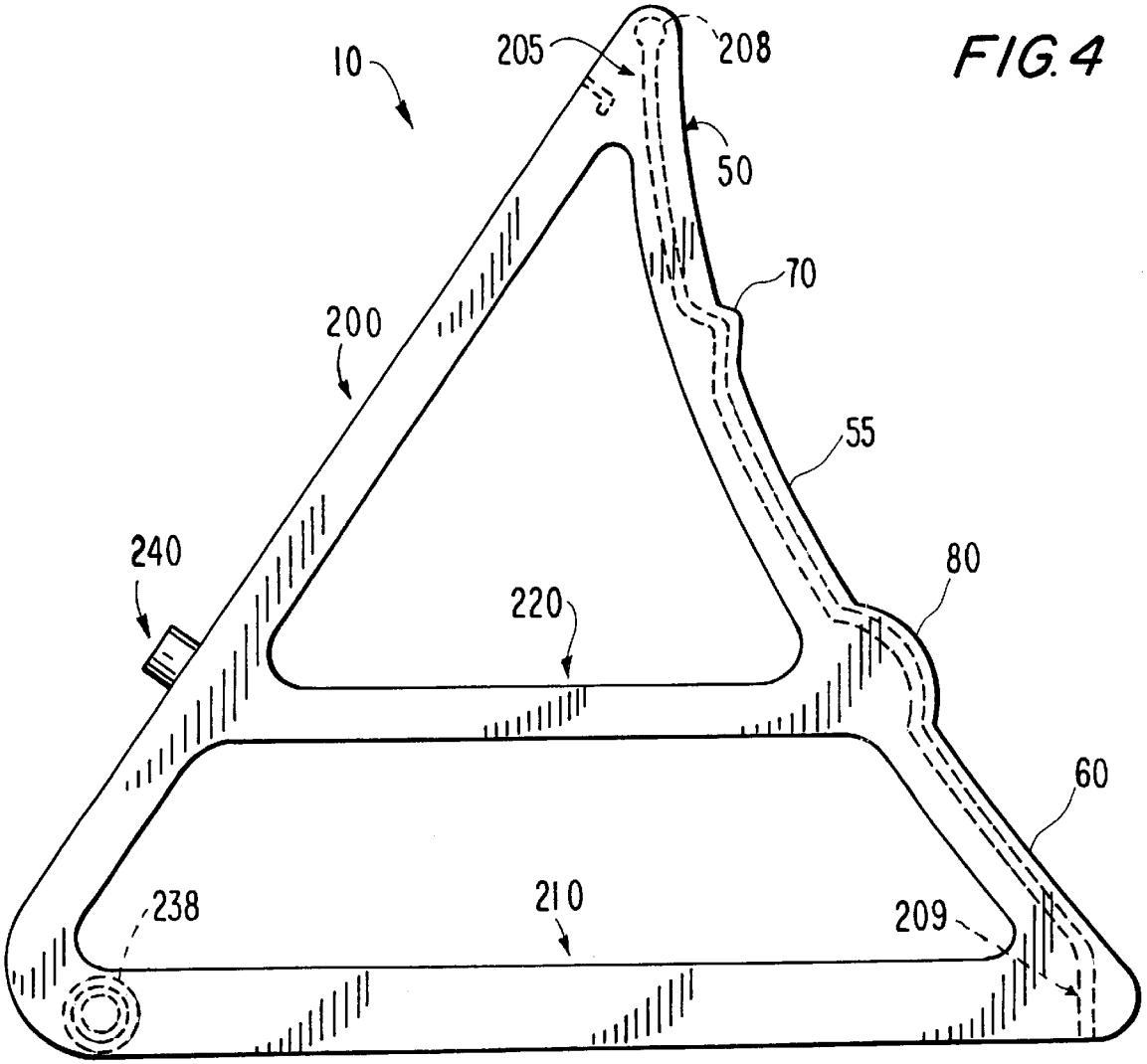
FIG. 4 is a side view of the embodiment of FIG. 3.

FIGS. 3 and 4 illustrate a second preferred embodiment of the portable stoopball playing device 10. In this embodiment, the device 10 is comprised of a playing panel 20 and a triangular brace support structure 200 which itself is comprised of two triangular face braces 205 (only one of which is shown in FIGS. 3 and 4) and a spreader bar 230. The playing panel 20 is similar to the playing panel 20 discussed in reference to FIGS. 1 and 2.

In this embodiment, the triangular brace support structure 200 replaces the supporting panel 30 of FIGS. 1 and 2. The support structure 200 may be constructed of plastic or other lightweight materials such as wood or aluminum. As noted earlier, the triangular brace support structure 200 is comprised of two triangular face braces 205, one on each lateral side of the playing panel 20, each triangular face brace having complimentary characteristics. The interior of each triangular face brace 205 defines a slot (not shown) into which the playing panel 20 may be inserted. The slot may run from the top of the triangular face brace 205, as indicated by point 208, to the bottom of the triangular face brace 205 as indicated by point 209. Further, each triangular face brace 205 may be comprised of several support channels 210 and 220. Support channel 210 may be situated along the bottom of the triangular face brace 205. Support channel 220 may be situated along the center of the triangular face brace 205, near the convex horizontal protrusion 80 of the incident panel.

The two triangular face braces 205 may be attached to each other through the use of a spreader bar 230, thereby providing further stability to the playing device 10. The spreader bar 230 may be inserted into receiving stations 238 at each of the triangular face braces 205. A bungee cord tensioner (not shown) may further be attached between the two support channels 220 to keep the components together under tension.

Each of the triangular face braces 205 may be hollow or solid. If the triangular face braces 205 are hollow, additional stability may be provided through the use of a ballast substance such as water or sand. Each hollow triangular face brace 205 may also have a capped opening 240. The opening 240 may be opened by the player, and a ballast substance such as water or sand, but not limited thereto, may be poured into the triangular face brace 205. After the hollow structure has been filled appropriately, the opening may once again be capped to prevent the ballast substances from exiting. Once the player is ready to store the playing device 10, the capped opening 240 may be opened and each of the hollow triangular face braces 205 may be drained.

Figure 5:
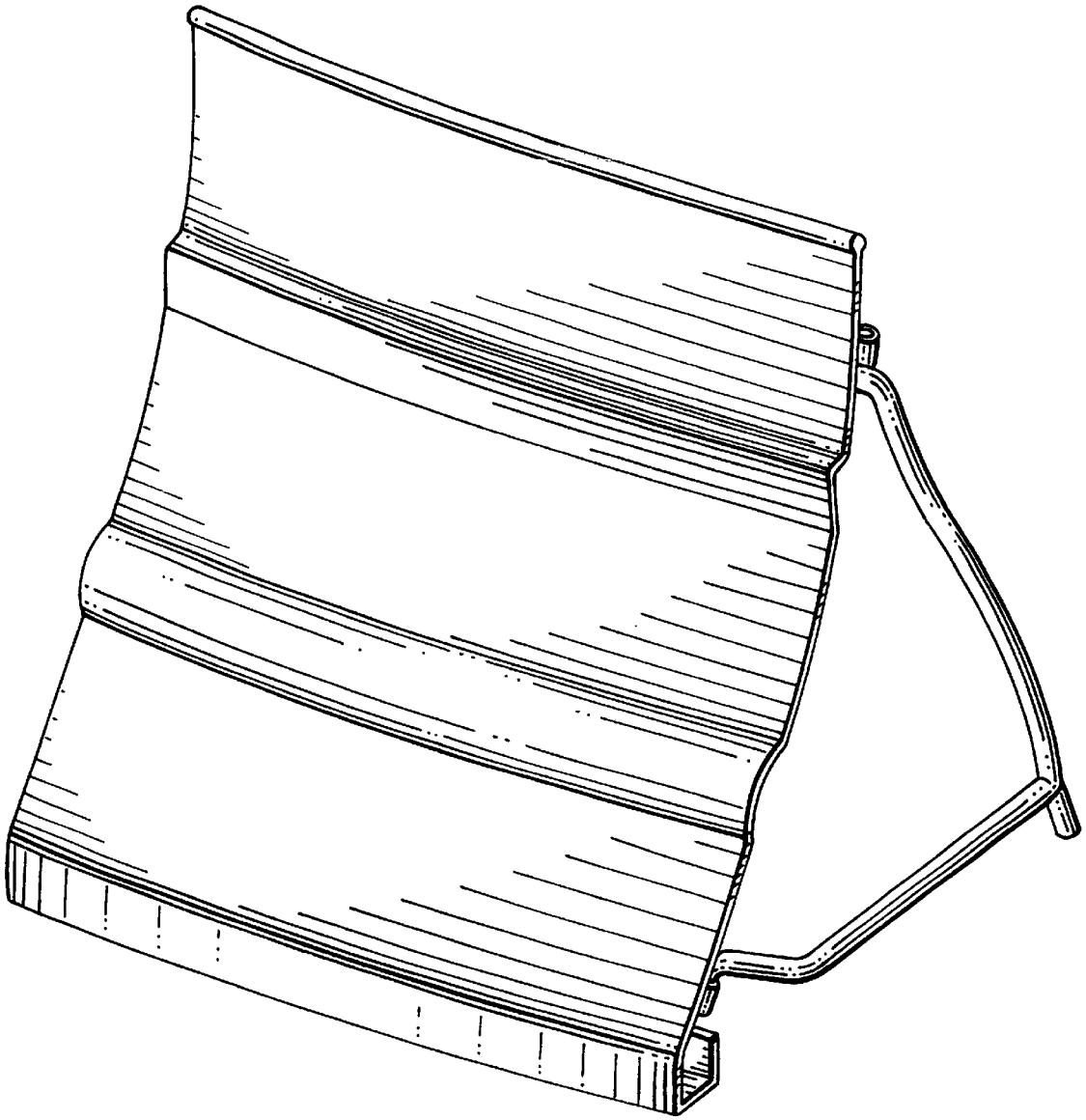
FIG. 5 is a perspective view of still another embodiment of the portable stoopball playing device of the present invention, showing the playing panel hingeably attached to one of the metal support legs.

FIG. 5 illustrate a third preferred embodiment of the portable stoopball playing device 10 of the present invention. In this embodiment, the device 10 is comprised of a playing panel 20 and two folding support legs 100(only one of which is shown) hingeably attached to the inner surface 27 of the playing panel 20. The playing panel 20 is similar to the playing panel 20 discussed in reference to FIGS. 1 and 2.

In this embodiment, the folding support legs replace the supporting panel 30 of FIGS. 1 and 2. The folding support legs 100 may be constructed of plastic or other lightweight materials such as wood or aluminum. Each folding support leg 100 is comprised of an angled vertical brace member 120 and a horizontal brace member 130 which are connected to each other at a point near the end of the angled vertical brace member 120 which is not hingeably attached to the playing panel 20. The attachment of the angled vertical brace member 120 to the horizontal brace member 130 is such that the angled vertical brace member 120 extends beyond the point of attachment to the horizontal brace member 130, in a direction away from the top attachment point 110 at which it is hingeably attached to the playing panel 20. This extension of the angled vertical brace member 120 forms a support leg and includes a foot 140 which rests flush on the surface on which the playing device 10 is deployed.

The folding support legs are hingeably attached to the inner surface 27 of the playing panel 20 thus: the angled vertical support member 120 is hingeably attached to the rear surface 27 of the playing panel 20 at a top attachment point 110 located on the inner surface 27 of the playing panel 20, near a lateral edge thereof, at a point midway between the top edge of the playing surface 20 and the first protrusion 70. The horizontal brace 130 is hingeably attached to the rear surface 27 of the playing panel 20, near a lateral edge thereof, at a point between the second protrusion 80 and the surface edge 90. Each folding support leg 100 is hingeably movable about the attachment points 110, 140 between a closed position, wherein the folding support legs 100 are flush with the inner surface 27 of playing panel 20, and an open position, wherein each folding support leg extends away from the inner surface 27 of the playing panel 20 in a direction opposite that of the playing surface 25 of the playing panel 20, and forms a right angle with the playing surface 20. Each of the folding support legs 100 may be hollow or solid.

While the invention has been described with respect to certain specific embodiments, it will be appreciated that many modifications and changes may be made by those skilled in the art without departing from the invention. It is intended, therefore, by the appended claims to cover all such modifications and changes as may fall within the true spirit and scope of the invention.

What is claimed is:

1. A portable stoopball playing device comprising:

a rectangular playing panel having an inner surface and an outer playing surface, said surfaces circumscribed by a top edge, two lateral edges, and a bottom surface edge, said playing panel describing a vertical curvature extending from said top edge of said outer playing surface to said bottom surface edge of said outer playing surface and a horizontal curvature extending between said two lateral edges of said outer playing surface, and having a hollow weight channel extending along a width of said surface edge; said outer playing surface having a plurality of sheer face segments, and a plurality of protrusions;

a support panel having an inner surface and an outer surface circumscribed by a top edge, two lateral edges, and a bottom edge, said top edge of said support panel being hingeably attached to said top edge of said playing panel and moveable between at least one open deployed position and a closed storage position; said support panel having an inner surface and an outer surface, said outer surface describing a vertical curvature and a horizontal curvature complimentary to that of said playing panel such that when said playing panel and said support panel are in said closed storage position, said inner side of said playing panel is flush with said inner side of said support panel;

whereby a person can throw a ball against said outer playing surface of said playing panel and rebound the ball at different angles and speeds depending on how the ball is thrown.

2. The stoopball playing device of claim 1 wherein at least one of said plurality of protrusions is a sharp horizontal edge and at least one other of said plurality of protrusions is a convexly curved edge.

3. The stoopball playing device of claim 1, wherein said horizontal curvature of said playing panel is convex.

4. The stoopball playing device of claim 1, wherein said horizontal curvature of said playing panel is concave.

5. The stoopball playing device of claim 1, wherein said bottom edge of said support panel further comprises at least one protrusion hingeably attached to said bottom edge of said support panel, said at least one protrusion being able to be inserted into a permeable surface on which said stoopball playing device is deployed, thus increasing stability.

6. The stoopball playing device of claim 1, wherein said inner surface of said playing panel is configured and arranged to dampen a sound made by an object striking said outer playing surface of said playing panel.

7. The stoopball playing device of claim 1, wherein said inner surface of said playing panel further includes one or more rigid thin ribs configured and arranged to dampen the sound made by an object striking said outer playing surface of said playing panel.

8. The stoopball playing device of claim 7, wherein said rigid thin ribs on said inner surface of said playing panel are configured and arranged on said inner surface as follows: between said top edge and an area of said inner surface corresponding to said at least one protrusion, and between the area of said inner surface corresponding to said at least one protrusion and said bottom surface edge.

9. A portable stoopball playing device comprising:

a playing panel having an outer playing surface and an inner surface, said surfaces circumscribed by a top edge, a bottom surface edge, and two lateral edges, said playing panel describing a vertical curvature extending from said top edge of said outer playing surface to said bottom surface edge of said outer playing surface and a horizontal curvature extending between said two lateral edges of said outer playing surface, and a hollow weight channel extending along a width of said surface edge, and said outer playing surface having a plurality of sheer face segments, and a plurality of protrusions; and a triangular brace support structure comprising a plurality of triangular face braces, each triangular face brace having a slot into which a lateral edge of said playing panel is inserted, a plurality of support channels, and a receiving station; and a spreader bar running parallel to said playing panel and coupleable to each of said plurality of triangular face braces at said receiving stations;

whereby a person can throw a ball against said outer playing surface of said playing panel and rebound the ball at different angles and speeds depending on how the ball is thrown.

10. The stoopball playing device of claim 9, wherein each of said plurality of triangular face braces is hollow.

11. The stoopball playing device of claim 10, wherein each of said plurality of hollow triangular face braces further comprises a capped opening which provides access to an interior of each of said plurality of hollow triangular face braces.

12. The stoopball playing device of claim 9, wherein at least one of said plurality of protrusion is a sharp horizontal edge and at least one other of said plurality of protrusions is a convexly curved edge.

13. The stoopball playing device of claim 9, wherein said horizontal curvature of said playing panel is convex.

14. The stoopball playing device of claim 9, wherein said horizontal curvature of said playing panel is concave.

15. The stoopball playing device of claim 9, wherein said bottom edge of said support panel further comprises at least one protrusion hingeably attached to said bottom edge of said support panel, said at least one protrusion being able to be inserted into a permeable surface on which said stoopball playing device is deployed, thus increasing stability.

16. The stoopball playing device of claim 9, wherein said inner surface of said playing panel is configured and arranged to dampen a sound made by an object striking said outer playing surface of said playing panel.

17. The stoopball playing device of claim 9, wherein said inner surface of said playing panel further includes one or more rigid thin ribs configured and arranged to dampen the sound made by an object striking said outer playing surface of said playing panel.

18. The stoopball playing device of claim 9, wherein said rigid thin ribs on said inner surface of said playing panel are configured and arranged on said inner surface as follows: between said top edge and an area of said inner surface corresponding to said at least one protrusion, and between the area of said inner surface corresponding to said at least one protrusion and said bottom surface edge.

19. A portable stoopball playing device comprising:

a playing panel having an outer playing surface and an inner surface, said surfaces circumscribed by a top edge, two lateral edges, and a bottom surface edge, said playing panel describing a vertical curvature extending from said top edge of said outer playing surface to said bottom surface edge of said outer playing surface and a horizontal curvature extending between said two lateral edges of said outer playing surface, and having a hollow weight channel extending a width of said surface edge, said outer playing surface of said playing panel having a plurality of sheer face segments, and a plurality of protrusions; and a plurality of folding support legs hingeably attached to said inner surface of said playing panel at said lateral edges thereof and moveable about said hingeable attachment between an open deployed position and a closed flush position, each of said plurality of folding support legs comprising an angled vertical support member hingeably attached to said inner surface of said playing panel at a point near said top edge, and a horizontal brace member hingeably attached to said rear surface of said playing panel at a point near said surface edge thereof said angled vertical support member being attached to said horizontal brace member to form said folding support leg;

whereby a person can throw a ball against said outer playing surface of said playing panel and rebound the ballat different angles and speeds depending on how the ball is thrown.

20. The stoopball playing device of claim 19, wherein at least one of said plurality of protrusions is a sharp horizontal edge and at least one other of said plurality of protrusions is a convexly curved edge.

21. The stoopball playing device of claim 19, wherein said horizontal curvature of said playing panel is convex.

22. The stoopball playing device of claim 19, wherein said horizontal curvature of said playing panel is concave.

23. The stoopball playing device of claim 19, wherein said bottom edge of said support panel further comprises at least one protrusion hingeably attached to said bottom edge of said support panel, said at least one protrusion being able to be inserted into a permeable surface on which said stoopball playing device is deployed, thus increasing stability.

24. The stoopball playing device of claim 19, wherein said inner surface of said playing panel is configured and arranged to dampen a sound made by an object striking said outer playing surface of said playing panel.

25. The stoopball playing device of claim 19, wherein said inner surface of said playing panel further includes one or more rigid thin ribs configured and arranged to dampen the sound made by an object striking said outer playing surface of said playing panel.

26. The stoopball playing device of claim 19, wherein said rigid thin ribs on said inner surface of said playing panel are configured and arranged on said inner surface as follows: between said top edge and an area of said inner surface corresponding to said at least one protrusion, and between the area of said inner surface corresponding to said at least one protrusion and said bottom surface edge.

* * * * *